US007841845B2

(12) United States Patent
Ignatiev

(10) Patent No.: US 7,841,845 B2
(45) Date of Patent: Nov. 30, 2010

(54) OPEN DRIVE SCROLL MACHINE

(75) Inventor: Kirill Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 85 days.

(21) Appl. No.: 11/130,347

(22) Filed: May 16, 2005

(65) Prior Publication Data

US 2006/0257273 A1 Nov. 16, 2006

(51) Int. Cl.
*F01C 1/02* (2006.01)

(52) U.S. Cl. ..... 418/55.1; 418/54

(58) Field of Classification Search ..... 418/55.1
See application file for complete search history.

(56) References Cited

U.S. PATENT DOCUMENTS 1,738,645 A * 12/1929 Gilman ..... 418/3
2,059,830 A 11/1936 Warner
2,669,098 A 2/1954 Buell
2,725,825 A 12/1955 Cibattari
2,925,723 A 2/1960 Hagen et al.
2,992,769 A * 7/1961 Manzanera ..... 418/61.1
3,141,310 A 7/1964 Hoffstrom
3,211,365 A 10/1965 Phelps
3,213,640 A 10/1965 Dubinsky et al.
3,279,683 A 10/1966 Kleinlein
3,285,504 A 11/1966 Smith
3,494,145 A 2/1970 Davis et al.
3,908,396 A 9/1975 Windsor
3,924,977 A 12/1975 McCullough
4,015,438 A 4/1977 Kinsell et al.
4,137,006 A 1/1979 Becker
4,137,021 A 1/1979 Lassota
4,206,596 A * 6/1980 Kuziak et al. ..... 60/791
4,260,402 A 4/1981 Shaffer et al.
4,293,281 A 10/1981 Lamoreaux
4,305,192 A 12/1981 Becker
4,325,683 A 4/1982 Miyazawa
4,340,339 A 7/1982 Kiraga et al.
4,431,356 A 2/1984 Lassota
4,468,181 A 8/1984 Sakamoto (Continued)

FOREIGN PATENT DOCUMENTS

JP 2005048598 A * 2/2005

OTHER PUBLICATIONS

First Office Action received from the State Intellectual Property Office of People's Republic of China regarding Application No. 2005101135609, dated Jan. 15, 2010. Translation provided by Unitalen Attorneys at Law.

*Primary Examiner*—Thomas Denion
*Assistant Examiner*—Douglas J. Duff
(74) *Attorney, Agent, or Firm*—Harness, Dickey & Pierce, P.L.C.

(57) ABSTRACT

A compressor assembly includes a planetary gear train located between an input shaft from the power unit and a drive shaft of the compressor. The planetary gear train is switchable between a high speed and a low speed condition. In the high speed condition, power is provided to the planetary gears, the ring gear is locked and output to the drive shaft is through the sun gear. In the low speed condition, a one-way clutch between the input shaft and the output shaft provides a one-to-one driving ratio.

31 Claims, 2 Drawing Sheets

U.S. PATENT DOCUMENTS 4,527,963 A 7/1985 Terauchi
4,547,138 A 10/1985 Mabe et al.
4,551,065 A 11/1985 Becker
4,551,081 A 11/1985 Sato et al.
4,575,319 A 3/1986 Terauchi
4,648,814 A 3/1987 Shiibayashi
4,800,782 A * 1/1989 Sivalingam ..... 475/318
4,824,345 A 4/1989 Fukuhara et al.
4,900,238 A 2/1990 Shigemi et al.
4,913,635 A 4/1990 Ochiai et al.
4,922,781 A * 5/1990 Peiji ..... 74/462
5,052,096 A 10/1991 Fuller et al.
5,098,265 A 3/1992 Machida et al.
5,110,268 A 5/1992 Sakurai et al.
5,137,437 A 8/1992 Machida et al.
5,172,753 A 12/1992 Kadle et al.
5,199,280 A 4/1993 Riffe et al.
5,222,885 A 6/1993 Cooksey
5,242,284 A 9/1993 Mitsunaga et al.
5,247,738 A 9/1993 Yoshii
5,269,661 A 12/1993 Iizuka et al.
5,290,160 A 3/1994 Ito et al.
5,312,234 A 5/1994 Yoshii
5,330,335 A 7/1994 Teracuhi et al.
5,346,376 A 9/1994 Bookbinder et al.
5,354,184 A 10/1994 Forni
5,358,392 A 10/1994 Ukai
5,360,319 A * 11/1994 Swain et al. ..... 417/223
5,362,211 A 11/1994 Iizuka et al.
5,374,166 A 12/1994 Fukui
5,391,066 A 2/1995 Sawai et al.
5,447,415 A 9/1995 Fukui
5,520,524 A 5/1996 Takemoto et al.
5,535,601 A 7/1996 Teraoka
5,540,571 A 7/1996 Yoshida et al.
5,545,020 A 8/1996 Fukanuma et al.
5,564,186 A 10/1996 Hori et al.
5,580,228 A 12/1996 Ishikawa et al.
5,599,178 A 2/1997 Yuzaki et al.
5,645,408 A 7/1997 Fujio et al.
5,678,986 A 10/1997 Terauchi et al.
5,683,236 A 11/1997 Harrison et al.
5,807,089 A 9/1998 Tsumagari et al.
6,129,531 A 10/2000 Elson et al.
6,139,256 A 10/2000 Freeman et al.
6,158,980 A 12/2000 Tsumagari et al.
6,164,940 A 12/2000 Terauchi et al.
6,234,769 B1 5/2001 Sakai et al.
6,315,536 B1 11/2001 DeVore et al.
6,354,821 B1 * 3/2002 Hahn et al. ..... 418/55.1
6,358,349 B1 3/2002 Christenson et al.
6,375,436 B1 4/2002 Irie et al.
6,443,712 B2 9/2002 Sakai et al.
6,544,009 B2 4/2003 Makino et al.
6,544,014 B2 4/2003 Kobayashi
6,589,022 B2 7/2003 Yokomachi et al.
6,607,367 B1 8/2003 Shibamoto et al.
6,616,431 B2 9/2003 Kitano et al.
6,617,727 B2 9/2003 Iwasa et al.
6,638,027 B2 10/2003 Mohrmann
6,644,932 B2 11/2003 Kelm et al.
6,644,933 B2 11/2003 Light et al.
6,659,727 B2 12/2003 Major et al.
6,659,738 B2 12/2003 Iwanami et al.
6,662,580 B2 12/2003 Suitou et al.
6,685,437 B2 * 2/2004 Koenig et al. ..... 417/15
6,715,995 B2 4/2004 Kelm et al.
6,722,861 B2 * 4/2004 Loprete et al. ..... 417/410.5
6,733,251 B2 5/2004 Sakurabayashi et al.
6,737,773 B2 5/2004 Hayashi et al.
6,742,350 B2 6/2004 Suzuki et al.
6,755,030 B2 6/2004 Adaniya et al.
6,761,037 B2 7/2004 Tsuboi et al.
6,786,055 B2 9/2004 Inoue et al.
6,802,187 B2 10/2004 Kawahara
6,830,438 B2 12/2004 Iwanami et al.
6,851,940 B2 2/2005 Ono
6,874,328 B2 4/2005 Suzuki et al.
6,874,996 B2 4/2005 Iwanami et al.
6,884,047 B1 4/2005 Liepert et al.
6,939,114 B2 9/2005 Iwanami et al.
6,986,645 B2 1/2006 Iwanami et al.
6,993,910 B2 2/2006 Iwanami et al.
7,021,902 B2 4/2006 Terauchi
7,083,397 B1 * 8/2006 Loprete et al. ..... 417/410.5
2002/0098100 A1 7/2002 Mori et al.
2002/0098101 A1 7/2002 Mori et al.
2003/0017070 A1 1/2003 Moroi et al.
2003/0053916 A1 3/2003 Terauchi
2003/0072662 A1 4/2003 Reinhart
2003/0091444 A1 5/2003 Kelm et al.
2003/0143087 A1 7/2003 Kelm et al.
2003/0143095 A1 7/2003 Ono
2003/0152467 A1 8/2003 Higashiyama et al.
2003/0156961 A1 8/2003 Iizuka
2004/0001760 A1 1/2004 Yoshii et al.
2004/0009073 A1 1/2004 Sato et al.
2004/0115081 A1 6/2004 Ono
2004/0146419 A1 7/2004 Kawaguchi et al.
2004/0165995 A1 8/2004 Suzuki et al.
2004/0179959 A1 9/2004 Hasegawa
2004/0184923 A1 9/2004 Iwanami et al.
2004/0184926 A1 9/2004 Iwasa et al.
2004/0202550 A1 10/2004 Kawaguchi et al.
2004/0258542 A1 12/2004 Wiertz et al.
2004/0265143 A1 12/2004 Kawahara et al.
2004/0265144 A1 12/2004 Fukanuma et al.
2005/0002816 A1 1/2005 Okayama et al.
2005/0025650 A1 2/2005 Hsia
2005/0025651 A1 2/2005 Sowa et al.
2005/0074339 A1 4/2005 Asa et al.
2005/0084403 A1 4/2005 Liepert et al.
2005/0129556 A1 6/2005 Ito
2005/0193734 A1 9/2005 Iwanami et al.
2005/0196297 A1 9/2005 Baumgartner et al.
2005/0196298 A1 9/2005 Manning
2005/0214148 A1 9/2005 Ogawa et al.
2005/0220642 A1 10/2005 Uno et al.
2005/0220646 A1 * 10/2005 Ogawa et al. ..... 418/55.2
2005/0220651 A1 10/2005 Tsukamoto et al.
2005/0232799 A1 10/2005 Sato
2005/0262689 A1 12/2005 Sato
2005/0265879 A1 12/2005 Tsuchiya et al.
2005/0271534 A1 12/2005 Yokoyama
2006/0051227 A1 3/2006 Tarng
2006/0057012 A1 3/2006 Park et al.

* cited by examiner

OPEN DRIVE SCROLL MACHINE

FIELD OF THE INVENTION

The present invention relates to open drive scroll machines. More particularly, the present invention relates to scroll compressors which are exteriorly driven and which incorporate a unique two speed drive system for the open drive scroll machine.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate scroll members having a pair of intermeshed spiral wraps, one of which is caused to orbit relative to the other so as to define one or more moving chambers which progressively decrease in size as they travel from an outer suction port toward a center discharge port. Some type of power unit is provided which operates to drive the orbiting scroll member via a suitable drive shaft. The bottom or lower portion of the housing which contains the scroll members normally contains an oil sump for lubrication of the various components of the compressor.

Scroll machines can be separated into two categories based upon the power unit which drives the scroll member. The first category is scroll machines which have the power unit located within the housing along with the scroll members. The housing containing the power unit and the scroll members can be open to the environment or it can be sealed to provide a hermetic scroll machine wherein the housing also contains the working fluid of the scroll machine. The second category of scroll machines is scroll machines which have the power unit separate from the housing containing the scroll members. These machines are called open drive scroll machines and the housing which contains the scroll members is normally sealed from the environment such that the housing also contains the working fluid of the scroll machine. The power unit for these open drive scroll machines can be provided by a drive belt and a pulley system, a gear drive system, a direct drive system or any other type of drive system.

The above categories of scroll machines can each be further subdivided into two additional categories of whether the scroll members are positioned vertically which is most common with the hermetic compressors or whether the scroll members are positioned horizontally which is most common with the open drive type of scroll machines.

Both the vertical and the horizontal positioned scroll machines perform satisfactorily in their respective market. Typically the power unit for these scroll machines is a single speed drive or a more expensive variable speed drive system. Various applications for scroll machines would benefit if a scroll machine had a low speed capability and a high speed capability. These two speed scroll machines could be produced at a cost significantly lower than the variable speed scroll machines and thus inexpensively satisfy the market for the applications which would benefit from a scroll machine having a low capacity capability and a high speed capability.

The present invention discloses a unique two speed drive system for an open drive horizontal scroll machine which functions to operate the scroll machine at a low speed capability when the scroll machine demand is low and a high speed capability when the scroll machine demand is high. A unique planetary gear system is positioned between the power unit and the drive shaft of the scroll machine to provide the two speed capability.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
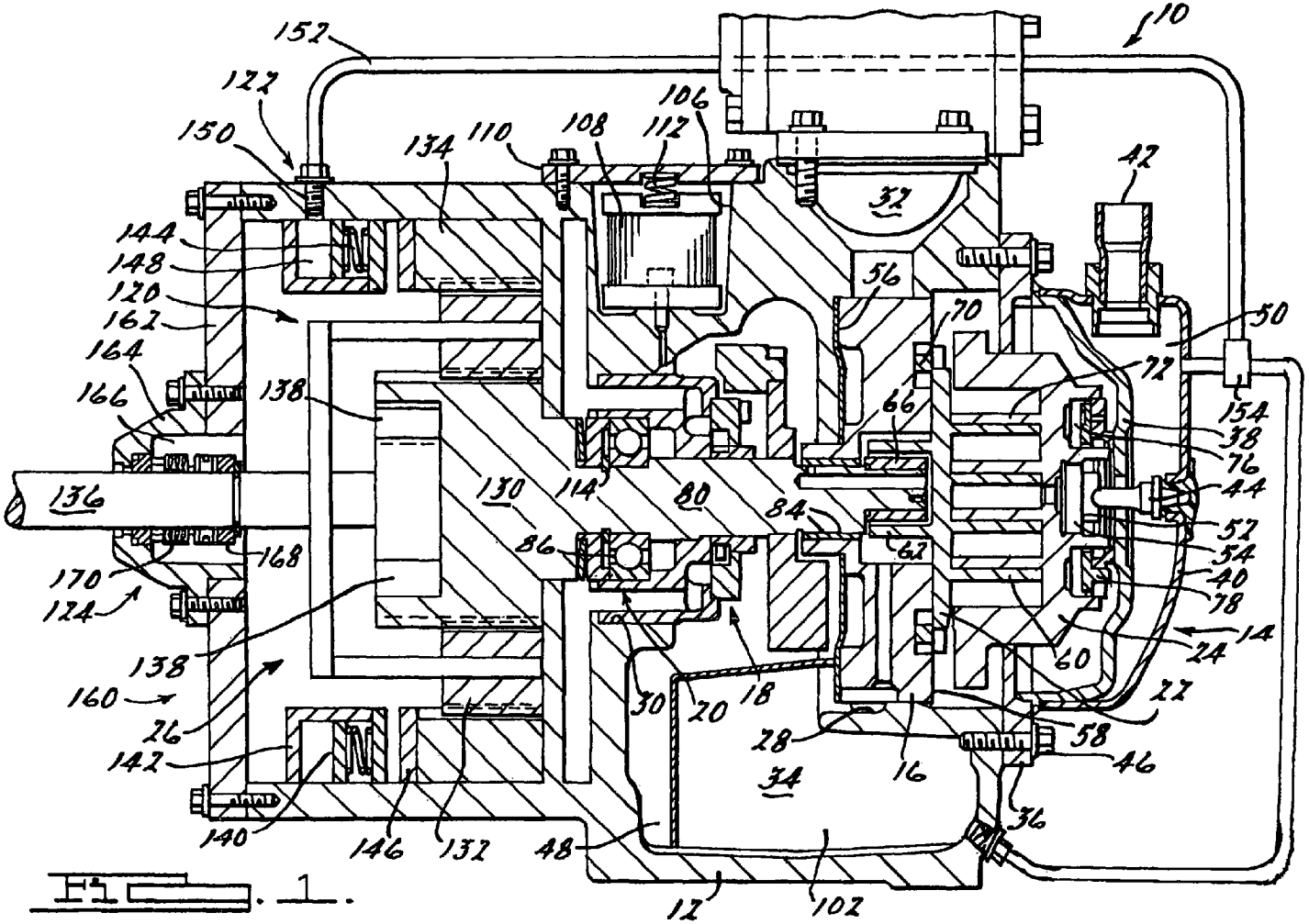
FIG. 1 is a vertical cross-section of an open drive horizontal scroll machine incorporating the unique drive system in accordance with the present invention.

Referring now to the drawing, there is shown in FIG. 1 an open drive horizontal scroll compressor which incorporates a unique two speed drive system in accordance with the present invention which is designated generally by reference numeral 10. Compressor 10 comprises a compressor body 12, a cap assembly 14, a main bearing housing 16, an oil pump assembly 18, a lower bearing assembly 20, an orbiting scroll member 22, a non-orbiting scroll member 24 and a two speed drive system 26. Compressor body 12 is a generally cup shaped member, preferably made from aluminum defining an internal cavity 28 within which is located main bearing housing 16, an internal bore 30 for mating with oil pump assembly 18 and lower bearing assembly 20 and a suction inlet 32 for mating with the refrigeration circuit associated with compressor 10. Compressor body 12, cap assembly 14 and lower bearing assembly 20 define a sealed chamber 34 within which scroll members 22 and 24 are disposed.

Cap assembly 14 comprises an adapter plate 36, a partition 38, a cap 40, a discharge fitting 42 and a temperature probe 44. Adapter plate 36 is secured to compressor body 12 using a plurality of bolts 46. Partition 38 is welded about its periphery to adapter plate 36 at the same point that cap 40 is welded to partition 38. Partition 38 separates chamber 34 into a suction chamber 48 and a discharge chamber 50. Discharge fitting 42 extends through cap 40 and provides a discharge gas outlet from discharge chamber 50 to the refrigeration circuit associated with compressor 10. Temperature probe 44 extends through cap 40 and partition 38 such that it is located within a discharge recess 52 located within non-orbiting scroll member 24. A dynamic discharge valve assembly 54 is located within discharge recess 52 and is retained within recess 52 by a nut threadingly received within recess 52.

Main bearing housing 16 is press fit into cavity 28 of compressor body 12 and rests against a shoulder 56 formed by cavity 28. The surface of main bearing housing 16 opposite to shoulder 56 is provided with a flat thrust bearing surface 58 against which is located orbiting scroll member 22 which has a usual spiral vane or wrap 60. Projecting opposite to wrap 60 is a cylindrical hub 62 having a journal bearing in which is rotatively disposed a drive bushing 66. An Oldham coupling 70 is also provided positioned between orbiting scroll member 22 and bearing housing 16. Oldham coupling 70 is keyed to orbiting scroll member 22 and non-orbiting scroll member 24 to prevent rotational movement of orbiting scroll member 22. Oldham coupling 70 is preferably of the type disclosed in assignee's U.S. Pat. No. 5,320,506, the disclosure of which is hereby incorporated herein by reference.

Non-orbiting scroll member 24 is also provided with a wrap 72 positioned in meshing engagement with wrap 60 of orbiting scroll member 22. Non-orbiting scroll member 24 has a centrally disposed passage which communicates with discharge recess 52 through discharge valve assembly 54 which is in turn in communication with discharge chamber 50 defined by cap 40 and partition 38. An annular recess 76 is also formed in non-orbiting scroll member 24 within which is disposed a seal assembly 78. Recesses 52 and 76 and seal assembly 78 cooperate to define axial pressure biasing chambers which receive pressurized fluid being compressed by wraps 60 and 72 so as to exert an axial biasing force on non-orbiting scroll member 24 to thereby urge the tips of respective wraps 60 and 72 into sealing engagement with the opposed end plate surfaces. Seal assembly 78 is preferably of the type described in greater detail in U.S. Pat. No. 5,156,539, the disclosure of which is hereby incorporated herein by reference. Non-orbiting scroll member 24 is designed to be mounted to bearing housing 16 in a suitable manner such as disclosed in U.S. Pat. No. 4,877,382 or U.S. Pat. No. 5,102,316 both disclosures of which are hereby incorporated herein by reference.

A steel drive shaft or crankshaft 80 having an eccentric crank pin at one end thereof is rotatably journalled in a sleeve bearing 84 in main bearing housing 16 and a roller bearing 86 in lower bearing assembly 20. The crank pin is drivingly disposed within the inner bore of drive bushing 66. The crank pin has a flat on one surface which drivingly engages a flat surface (not shown) formed in a portion of the bore of drive bushing 66 to provide a radially compliant drive arrangement, such as shown in assignee's aforementioned U.S. Pat. No. 4,877,382. Crankshaft 80 includes an axially extending bore which intersects with a radial inlet bore and a radial outlet bore. The end of crankshaft 80 opposite to the crank pin extends through lower bearing assembly 20 and is adapted to be connected to two speed drives system 26 which is being used to power crank shaft 80.

Oil pump assembly 18 is disposed within chamber 34 in concentric relationship to drive shaft 80. Oil pump assembly 18 comprises a housing, a pump body, a drive member and a plurality of vanes. The housing is secured to compressor body 12 using a plurality of bolts. The housing defines an oil inlet passage and an oil outlet passage. The pump body is secured to the housing using a plurality of bolts and thus the pump body is stationary. The pump body defines a pumping chamber within which the plurality of vanes are located. The drive member is drivingly secured to the drive shaft 80 such that rotation of drive shaft 80 causes rotation of the drive member. Rotation of drive shaft 80 causes rotation of the drive member which in turn causes rotation of the plurality or vanes in the pumping chamber and the pumping of oil between the inlet passage which is in communication with a supply passage which extends through compressor body 12 and which is in communication with an oil sump 102 located within sealed chamber 34 through a filter. The outlet passage is in communication with a supply passage which extends through compressor body 12 and is in communication with a filter chamber 106 formed by compressor body 12. An oil filter 108 is disposed within chamber 106 and chamber 106 is closed by a filter cap 110 which is secure to compressor body 12 using a plurality of bolts. Oil filter 108 is located between the supply passage and a return passage which leads back to oil sump 102. A spring 112 biases oil filter 108 away from filter cap 110 to ensure oil flows through filter 108 before entering the return passage. The return passage is a stepped diameter passage which restricts oil flow to increase the oil pressure thereby providing oil to the moving components of compressor 10.

Lower bearing assembly 20 comprises roller bearing 86 and a snap ring 114. Roller bearing 86 is disposed between drive shaft 80 and the housing of oil pump assembly 18 and snap ring 114 positions bearing 86 against a shoulder on drive shaft 80. A bearing spacer and a Belville spring are positioned between two speed drive system 26 and the outer race of bearing 86 to properly locate bearing 86.

Two speed drive system 26 comprises a planetary gear set 120, a clutch assembly 122 and an end cap assembly 124. Planetary gear set 120 comprises a sun gear 130, a plurality of planet gears 132 and a ring gear 134. Sun gear 130 is attached to drive shaft 80. The plurality of planet gears 132 are meshed with sun gear 130 and are attached to an input shaft 136. Input shaft 136 extends through end cap assembly 124 and provides for the driving input to power two speed drive system 26 and thus drive shaft 80. A one-way clutch 138 is disposed between input shaft 136 and sun gear 130. One-way clutch 138 allows sun gear 130 to rotate faster than input shaft 136 but will provide driving power from input shaft 136 to sun gear 130 when necessary as detailed below. Ring gear 134 is in mesh with the plurality of planet gears 132 and is rotatably disposed within compressor body 12.

Clutch assembly 122 comprises a clutch housing 140, a piston 142 a biasing member on spring 144 and a clutch plate 146. Clutch housing 140 is attached to compressor body 12 and is thus prohibited from rotation with respect to compressor body 12. Piston 142 and compressor body 12 define a chamber 148. An inlet port 150 extends through compressor body 12 to provide communication with chamber 148. A fluid pressure line 152 extends between inlet port 150 and discharge chamber 50. A solenoid valve 154 controls the flow of pressurized fluid through fluid pressure line 152.

Spring 144 biases piston 142 to the right as shown in FIG. 1 to engage clutch assembly 122. In its engaged position, clutch assembly 122 prohibits rotation of ring gear 134. With ring gear 134 locked, power from input shaft 136 is provided to planet gears 132 providing an increase in speed for sun gear 130. The increase in speed for sun gear 130 is facilitated by the incorporation off one-way clutch 138 which permits the faster rotation of sun gear 130. Sun gear 130 is attached to drive shaft 80 for powering compressor 10. Thus, when clutch assembly 122 is engaged, planetary gear set 120 increases the speed between input shaft 136 and drive shaft 80 to provide a high-speed capability for two speed drive system 26. The amount of speed increase between input shaft 136 and drive shaft 80 will be determined by the diameter of ring gear 134 and the diameter of sun gear 130.

When low speed operation for two speed drive system 26 of compressor 10 is desired, solenoid valve 154 is activated to place chamber 148 in communication with discharge chamber 50 through pressure line 152 and inlet port 150. Pressurize fluid within chamber 148 reacts against piston 142 to move piston 142 to the left as shown in FIG. 1 to release ring gear 134 for rotation. Typically, in a planetary gear train, input power drives one member, the second member is driven to provide the output and the third member is fixed. If the third member is not fixed, no power is delivered. One-way clutch 138 is incorporated to provide low speed operation of two speed drive system 26. When solenoid valve 154 is energized and chamber 148 is pressurized, clutch assembly 122 releases ring gear 134 for rotation. Sun gear 130 is no longer powered by planet gears 132 and thus sun gear 130 will begin to slow down. Sun gear 130 will slow down until one-way clutch 138 engages thus equalizing the speed between input shaft 136 and sun gear 130 resulting in a one-to-one or low speed rotation for two speed drive system 26.

When it is desired to return to the high speed operation of two-speed drive system 26, pressurized fluid-within chamber 148 is released into sealed chamber 34 by solenoid valve 154. The release of pressurized fluid from chamber 148 causes springs 144 to again move piston 142 to the right as shown in FIG. 1 engaging clutch assembly 122 to place two-speed drive system 26 in its high-speed condition.

Sealed chamber 34 is closed by an end cover assembly 160 which comprises a cover plate 162 and a bearing cover 164. Bearing cover 164 defines an internal chamber 166 having a plurality of circumferentially spaced radially extending ribs which position a spacer 168 and a plurality of seals 170 between input shaft 136 and bearing cover 164. Input shaft 136 extends through bearing cover 164 and is adapted for connection to an external power supply by methods known well in the art.

Thus, the incorporation of planetary gear set 120 and clutch assembly 122 provide a simple and relatively inexpensive method for providing a two-speed capability for compressor 10.

Figure 2:
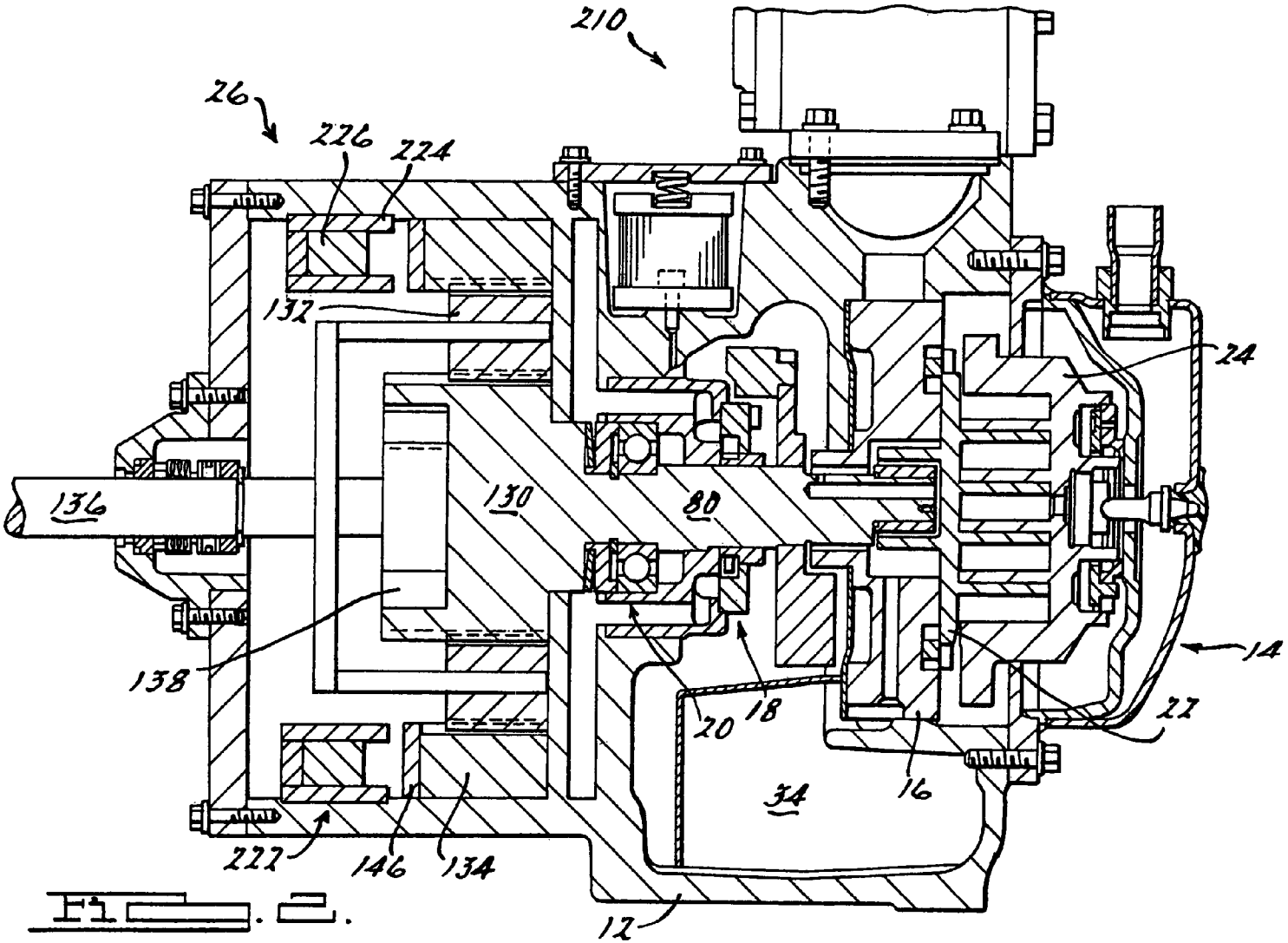
FIG. 2 is a vertical cross-section of an open drive horizontal scroll machine incorporating the unique drive system in accordance with another embodiment of the present invention.

Referring now to FIG. 2, an open drive horizontal scroll compressor which incorporates a unique two-speed drive system in accordance with another embodiment of the present invention is illustrated and is designated generally by the reference numeral 210.

Compressor 210 is the same as compressor 10 except that clutch assembly 122 has been replaced by clutch assembly or solenoid valve assembly 222. Solenoid valve assembly 222 comprises a solenoid core 224, a solenoid coil 226 and clutch plate 146.

At low input speeds or when high compressor capacity demand requirements are present, solenoid coil 226 is energized, thus attracting clutch plate 146 and locking it to solenoid core 224. In this locked position, rotation of ring gear 134 is prohibited. With ring gear 134 locked, power from input shaft 136 is provided to planet gears 132 which results in an increase in speed for sun gear 130. The increase in speed for sun gear 130 is facilitated by the incorporation of one-way clutch 138 which permits the faster rotation of sun gear 130. Sun gear 130 is attached to drive shaft 80 for powering compressor 210. Thus, when solenoid coil 226 is energized, planetary gear set 120 increases the speed between input shaft 136 and drive shaft 80 to provide a high-speed capability for two speed drive system 26. The amount of speed increase between input shaft 136 and drive shaft 80 will be determined by the diameter of ring gear 134 and the diameter of sun gear 130.

At higher input speeds or when lower compressor capacity demand requirements are present, solenoid coil 226 is de-energized which results in disengaging solenoid core 224 from clutch plate 146 which allows rotation of ring gear 134. Typically, in a planetary gear train, input power drives one member, the second member is provided to the output and the third member is fixed. If the third member is not fixed, no power is delivered. One-way clutch 138 is incorporated to provide low speed operation of two speed drive system 26. When solenoid coil 226 is de-energized, clutch assembly or solenoid valve 222 releases ring gear 134 for rotation. Sun gear 130 is no longer powered by planet gears 132 and thus, sun gear 130 will begin to slow down. Sun gear 130 will slow down until one-way clutch 138 engages, thus equalizing the speed between input shaft 136 and sun gear 130 resulting in a one-to-one or low speed rotation for two-speed drive-system 26.

When it is desired to return to the high speed operation of two-speed drive system 26, solenoid coil 226 can be energized again to engage clutch plate 146 with solenoid core 224 to plate two-speed drive system 26 in its high-speed condition.

Thus, the incorporation of planetary gear set 120 and solenoid valve assembly 222 provide a simple and relatively inexpensive method for providing a two-speed capability for compressor 210.

Two-speed drive system 26 with clutch assembly 122 or solenoid valve assembly 222 can be utilized to drive any other type of open-drive positive displacement compressor. While two-speed drive system 26 with clutch assembly 122 on solenoid valve assembly 222 have been illustrated as being located within sealed chamber 34, it is within the scope of the present invention to mount two-speed drive system 26 external to the compressor or sealed chamber 34. When mounted externally to the compressor or sealed chamber 34, two-speed drive system 26 can be packaged together with a drive pulley and the drive pulley clutch.

While two-speed drive system 26 is illustrated in use with a horizontal compressor, it can be integrated into a vertical hermetic compressor, if desired. Preferably, in the vertical hermetic compressor, two-speed drive system 26 is positioned between the motor rotor and the lower bearing. The sun gear is attached to the crankshaft, the rotor of the motor has bearings so it can rotate on the compressor shaft with the speed differential being between the crankshaft and the rotor. The rotor would then drive the planetary gear housing assembly. With the implementation of the above described mechanism, two-speed operation can be achieved using a single speed motor and because of the increased or high speed operation, larger compressor capabilities can be achieved in a smaller compressor frame or shell diameter.

While the above detailed description describes the preferred embodiment of the present invention, it should be understood that the present invention is susceptible to modification, variation and alteration without deviating from the scope and fair meaning of the subjoined claims.

What is claimed is:

1. A two speed compressor assembly comprising:

a compressor having a housing;

a drive shaft rotatably supported with respect to said housing and engaging said compressor;

an input shaft rotatably supported with respect to said housing for driving said drive shaft in a high speed condition and a low speed condition;

a one-way clutch disposed between said drive shaft and said input shaft, said one-way clutch limiting relative rotation between said drive shaft and said input shaft to a single direction; and a gear system including a sun gear, a plurality of planetary gears and a ring gear disposed between said drive shaft and said input shaft, said drive shaft being attached to said sun gear such that said one-way clutch is disposed between said input shaft and said sun gear, said gear system being selectively switchable between said high speed condition where said drive shaft rotates faster than said input shaft and said low speed condition where said drive shaft rotates at the same speed as said input shaft, said planetary gears being fixedly coupled to said input shaft and always rotating with rotation of said input shaft;

a clutch assembly disposed between said gear system and said housing and operable to switch said gear system between said high and low speed conditions, said clutch assembly including a biasing member that biases a component of said clutch assembly into engagement with a component of said gear system and said engagement corresponding to said high speed condition.

2. The two speed compressor assembly in claim 1 wherein said drive shaft rotates at the same speed as said input shaft when said gear system is in said low speed condition.

3. The two speed compressor assembly in claim 1 wherein said ring gear is locked to said housing when said gear system is in said high speed condition.

4. The two speed compressor assembly in claim 1 wherein said input shaft is attached to said plurality of planetary gears.

5. The two speed compressor assembly in claim 1 wherein said clutch assembly is disposed between said ring gear and said housing.

6. The two speed compressor assembly of claim 1 wherein said sun gear is fixedly coupled to and drives rotation of said drive shaft in both of said high and low speed conditions.

7. A scroll machine comprising:

a housing;

a power supply external to said housing;

a first scroll member disposed within said housing, said first scroll member having a first spiral wrap;

a second scroll member disposed within said housing, said second scroll member having a second spiral wrap intermeshed with said first spiral wrap;

a drive shaft rotatably supported with respect to said housing, said drive shaft receiving rotational input and transferring said rotational input to one of said scroll members for causing said scroll members to orbit relative to one another whereby said spiral wraps will create pockets of progressively changing volume and are operable to compress a working fluid from a suction pressure to a discharge pressure;

an input shaft actuated by said power supply that is rotatably supported with respect to said housing and that drives said drive shaft;

a one-way clutch disposed between said input shaft and said drive shaft;

a gear system including a sun gear, a plurality of planetary gears, and a ring gear disposed between said drive shaft and said input shaft, said drive shaft being attached to said sun gear such that said one-way clutch is disposed between said input shaft and said sun gear, and said gear system being selectively switchable between a high speed condition and a low speed condition; and a clutch assembly operable to switch said gear assembly between said high and low speed conditions, said clutch assembly switching said gear assembly between one of said high and low speed conditions to the other one of said high and low speed conditions in response to receiving working fluid compressed by said scroll members to a pressure greater than said suction pressure.

8. The scroll machine in claim 7 wherein said drive shaft rotates faster than said input shaft when said gear system is in said high speed condition.

9. The scroll machine in claim 8 wherein said drive shaft rotates at the same speed as said input shaft when said gear system is in said low speed condition.

10. The scroll machine in claim 7 wherein said drive shaft rotates at the same speed as said input shaft when said gear system is in said low speed condition.

11. The scroll machine in claim 7 wherein said input shaft is attached to said plurality of planetary gears and said drive shaft is attached to said sun gear.

12. The scroll machine in claim 11 further comprising a one-way clutch disposed between said input shaft and said sun gear.

13. The scroll machine in claim 7 wherein said clutch assembly is disposed between said ring gear and said housing.

14. The scroll machine in claim 7 wherein said clutch assembly is disposed between said gear system and said housing.

15. The scroll machine in claim 7 wherein said planetary gears are fixedly coupled to said input shaft and always rotate with rotation of said input shaft.

16. The scroll machine in claim 7 wherein said clutch assembly biases said gear assembly to said high speed condition.

17. The scroll machine in claim 7 wherein said clutch assembly includes a spring member and a clutch plate, said spring member biases said clutch plate into engagement with said ring gear.

18. The scroll machine in claim 16 wherein said compressed working fluid moves said clutch assembly from a first position corresponding to said high speed condition to a second position corresponding to said low speed position.

19. The scroll machine in claim 18 wherein said clutch assembly includes a housing fixed in the scroll machine, a movable piston, and a clutch plate coupled to said piston, and said compressed working fluid moves said piston and said clutch plate relative to said housing from said first position to said second position.

20. The scroll machine in claim 19 wherein said compressed working fluid is vented from said clutch assembly to a suction pressure location in said scroll machine to allow said clutch assembly to move from said second position to said first position.

21. The scroll machine in claim 7 wherein said ring gear is locked to said housing when said gear system is in said high speed condition.

22. The scroll machine in claim 7 wherein rotation of said input shaft results in rotation of said drive shaft regardless of said clutch assembly receiving working fluid.

23. A two speed compressor assembly comprising:

a compressor having a housing;

a drive shaft rotatably supported with respect to said housing and engaging said compressor;

an input shaft rotatably supported with respect to said housing for driving said drive shaft in a high speed condition and a low speed condition;

a gear system including a sun gear, a plurality of planetary gears, and a ring gear disposed between said drive shaft and said input shaft, said gear system being selectively switchable between said high speed condition where said drive shaft rotates faster than said input shaft and said low speed condition where said drive shaft rotates at the same speed as said input shaft, said planetary gears being fixedly coupled to said input shaft and always rotating with rotation of said input shaft, and said sun gear being fixedly coupled to said drive shaft and always rotating with rotation of said drive shaft; and a clutch assembly disposed between said gear system and said housing and operable to switch said gear system between said high and low speed conditions, said clutch assembly including a biasing member that biases a component of said clutch assembly into engagement with a component of said gear system and said engagement corresponding to said high speed condition.

24. The compressor assembly of claim 23, further comprising a one-way clutch disposed between said drive shaft and said input shaft, said one-way clutch limiting relative rotation between said drive shaft and said input shaft to a single direction.

25. The compressor assembly of claim 23, wherein said clutch assembly includes a piston and said component includes said ring gear.

26. The compressor assembly of claim 25, wherein said clutch assembly includes a chamber in fluid communication with a solenoid valve that selectively provides said chamber with a suction pressure or a discharge pressure to actuate said piston.

27. The compressor assembly of claim 26, wherein said high speed condition occurs when said chamber is exposed to said suction pressure and said low speed condition occurs when said chamber is exposed to said discharge pressure.

28. The compressor assembly of claim 23, wherein said drive shaft rotates at the same speed as said input shaft when said gear system is in said low speed condition.

29. The compressor assembly of claim 23, wherein said ring gear is locked to said housing when said gear system is in said high speed condition.

30. The compressor assembly of claim 24, wherein said drive shaft is attached to said sun gear, said one way clutch being disposed between said input shaft and said sun gear.

31. The compressor assembly of claim 26, wherein said piston includes said chamber.

* * * * *

UNITED STATES PATENT AND TRADEMARK OFFICE

CERTIFICATE OF CORRECTION

PATENT NO. : 7,841,845 B2
APPLICATION NO. : 11/130347
DATED : November 30, 2010
INVENTOR(S) : Ignatiev It is certified that error appears in the above-identified patent and that said Letters Patent is hereby corrected as shown below:

| | |
|---|---|
| Column 3, Line 38 | "drives" should be --drive--. |
| Column 4, Line 42 | "off" should be --of--. |
| Column 5, Line 4 | "fluid-within" should be --fluid within--. |
| Column 5, Line 64 | "drive-system" should be --drive system--. |
| Column 6, Line 2 | "to plate" should be --to place--. |

Signed and Sealed this
Thirty-first Day of May, 2011

David J. Kappos

David J. Kappos
*Director of the United States Patent and Trademark Office*